United States Patent [19]

Sorensen

[11] 4,123,644

[45] Oct. 31, 1978

[54] DEVICE FOR INDUCTIVELY HEATING CYLINDRICAL SURFACES

[75] Inventor: Phillips N. Sorensen, Bedford, Ohio

[73] Assignee: Park-Ohio Industries, Inc., Cleveland, Ohio

[21] Appl. No.: 768,164

[22] Filed: Feb. 14, 1977

[51] Int. Cl.[2] ..... H05B 5/02

[52] U.S. Cl. ..... 219/10.57; 219/10.79; 266/125

[58] Field of Search ..... 219/10.57, 10.79, 10.73; 266/125, 129; 148/145

[56] References Cited

U.S. PATENT DOCUMENTS

| | | | |
|---|---|---|---|
| 3,210,510 | 10/1965 | Cauy | 219/10.57 |
| 3,300,614 | 1/1967 | Sorensen | 219/10.79 |
| 3,488,236 | 1/1970 | Van Husen | 219/10.57 |
| 3,823,927 | 7/1974 | Budzinski | 219/10.57 |
| 3,854,707 | 12/1974 | Armstrong et al. | 219/10.57 |

*Primary Examiner*—Bruce A. Reynolds
*Attorney, Agent, or Firm*—Meyer, Tilberry & Body

[57] ABSTRACT

A device for inductively heating a cylindrical metal surface on an elongated workpiece having a central rotational axis, wherein the cylindrical surface is generally concentric with the axis. The device comprises an inductor having a generally cylindrical coupling surface matching the metal surface, a main support for carrying the inductor, the main support movable between a first position with the inductor spaced substantially from the cylindrical metal surface and a second position with the inductor in its heating position, and an intermediate frame for mounting the inductor onto the support. The intermediate frame comprises a first link having first and second ends, the link mounted on the main support at the first end for pivotal movement about an axis generally parallel to the central axis, a second link, the second link pivotally mounted on the first link for oscillation about an axis above and generally parallel to the central axis, the inductor mounted in the second link and selectively energizing the inductor when it is in its heating position.

14 Claims, 6 Drawing Figures

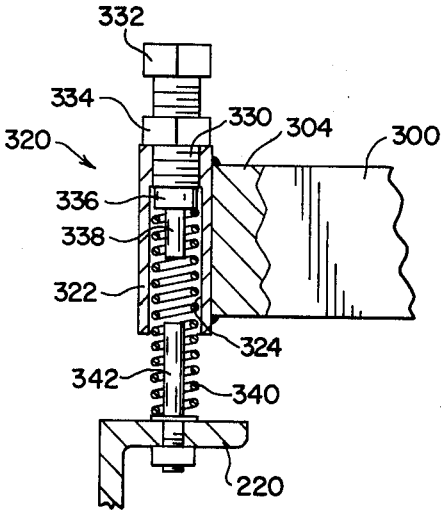
FIG. 5
FIG. 6
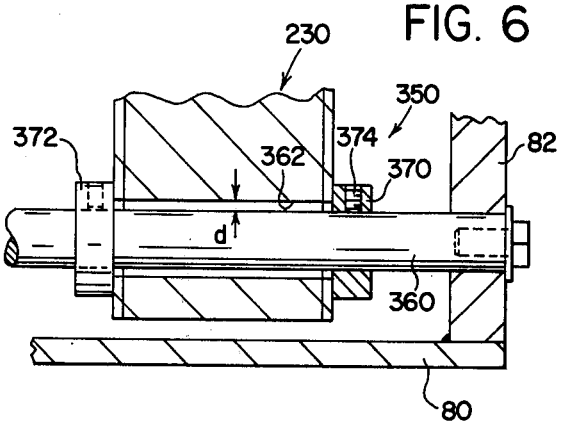

DEVICE FOR INDUCTIVELY HEATING CYLINDRICAL SURFACES

The present invention relates to the art of inductively heating metal workpieces and more particularly to a device for inductively heating a cylindrical surface of a metal workpiece.

BACKGROUND OF INVENTION

The invention is particularly applicable for inductively heating spaced main bearings of a crankshaft and it will be described with particular reference thereto; however, the invention has much broader applications and may be used for inductively heating cylindrical surfaces on elongated metal workpieces of various types. The cylindrical surfaces are generally concentric with the rotational axis of the elongated workpiece, except for variations caused by bowing of the workpiece and manufacturing tolerances thereof.

In the manufacture of crankshafts, of the type used in internal combustion engines, a large number of axially spaced cylindrical surfaces are employed. These surfaces are machined to the desired size and thereafter hardened. This hardening operation is generally performed by inductively heating the cylindrical surfaces as the crankshaft is rotated and then quench hardening the inductivity heated surfaces. The cylindrical surfaces form axially spaced bearing surfaces for operation of the crankshaft. A variety of machines have been developed for inductively heating and then quench hardening the various spaced cylindrical surfaces of the crankshaft. These machines generally involve an inductor placed in a fixed spaced relationship with a given surface and energized while the crankshaft is rotated. This arrangement progressively heats the cylindrical surface by induction heating. Thereafter, quenching liquid can be directed through the inductor against the heated surface for quench hardening the same. When the offset pin surfaces are being inductively heated and then quench hardened, the inductor must orbit as the crankshaft is being rotated. Special machines have been developed for this purpose. One of the machines is disclosed in prior U.S. Pat. No. 3,174,738, which is incorporated by reference herein for background. In this prior patent, a plurality of inductors are positioned on the pins of a crankshaft which is then rotated. Pressure is maintained on the inductor by a biasing arrangement which is counterbalanced to reduce the amount of pressure applied against the heated surface by locators riding on the inductors. This type of machine is adapted for heat treating the pin surfaces of a rotating crankshaft; however, such a machine is relatively expensive and complex for inductively heating the main bearing surfaces of a crankshaft, which bearing surfaces are generally concentric with the rotational axis of the crankshaft. The present invention relates to an improved device for heating the main bearings of a crankshaft, which device is less expensive than the complicated machine illustrated in the prior patent discussed above and is more efficient in operation.

STATEMENT OF INVENTION

In accordance with the present invention, there is provided a device for inductively heating a cylindrical metal surface on an elongated workpiece, such as a crankshaft, having a central axis which surface is generally concentric with the axis. The device comprises an inductor having a generally cylindrical coupling surface matching the metal surface, main support means for carrying the inductor, means for moving the support means between a first position with the inductor spaced substantially from the cylindrical metal surface and a second position with the inductor in its heating position, and an intermediate frame for mounting the inductor onto the support means. The intermediate frame comprises a first link having first and second ends, means for mounting the link on the main support means at the first end for pivotal movement about an axis generally parallel to the central axis, a second link, means for pivotally mounting the second link on the first link for oscillation about an axis above and generally parallel to the central axis of the workpiece, means for mounting the inductor on the second link and means for selectively energizing the inductor.

By providing a movable support means for moving the inductor between a remote position and a heating position, no counterbalancing of the inductor itself is required during this movement. When the inductor is in place in its heating position, then a relatively simple counterbalancing arrangement can be provided for maintaining a relatively light force between the inductor and the rotating cylindrical surface being inductively heated by the inductor. This provides more sensitivity and a better following action than a device which requires a long stroke counterbalancing action for counterbalancing both the movement of the inductor to its heating position and the force between the inductor and the rotating surface during the heating operation. Thus, the present invention relates to the concept of providing two separate movable frames for moving the inductor to its heating position. The second frame is used for allowing slight movement of the inductor to correspond with manufacturing differences and any bowing caused by processing of the crankshaft. In accordance with the present invention, a plurality of inductors are provided for simultaneously heating a number of main bearing surfaces. In this arrangement, the main support means or frame supports all inductors. Each of the inductors is then provided with its own frame means so that movement of the main frame brings the inductors into position with respect to the main bearings of a crankshaft. Thereafter, the individual frames, or sub frames, for each of the inductors allows independent movement of the various inductors to correspond with the spaced, rotating cylindrical surfaces.

In accordance with another aspect of the invention, the transformers are mounted on the sub frame means for relatively rigid connection to the individual inductors, which inductors are slightly movable with the transformers to compensate for variations in the rotating surface of spaced main bearings of the crankshaft.

The primary object of the present invention is the provision of a device for inductively heating a cylindrical surface of an elongated, rotating workpiece by a matching inductor, which device compensates for machining variations and workpiece bowing or distortion.

Another object of the present invention is the provision of a device as defined above, which device is simple in design and efficient in operation and provides closely spaced inductors for adjacent bearing surfaces.

Still a further object of the present invention is the provision of a device as defined above, which device has a first frame for moving the inductor into the heating position and a second frame for allowing movement of the inductor to obtain and maintain an efficient coupling gap or spacing.

A further object of the present invention is the provision of a device as defined above, which device does not require a long stroke counterbalancing mechanism and maintains a relatively light pressure between an inductor guide structure and the rotating cylindrical surface being inductively heated.

These and other objects and advantages will become apparent from the following description.

BRIEF DESCRIPTION OF DRAWINGS

In the description, the following drawings are employed.

FIG. 5 is an enlarged, partial cross-sectional view taken generally along line 5—5 of FIG. 2; and, FIG. 6 is an enlarged, partial cross-sectional view taken generally along line 6—6 of FIG. 3.

PREFERRED EMBODIMENT

Figure 1:
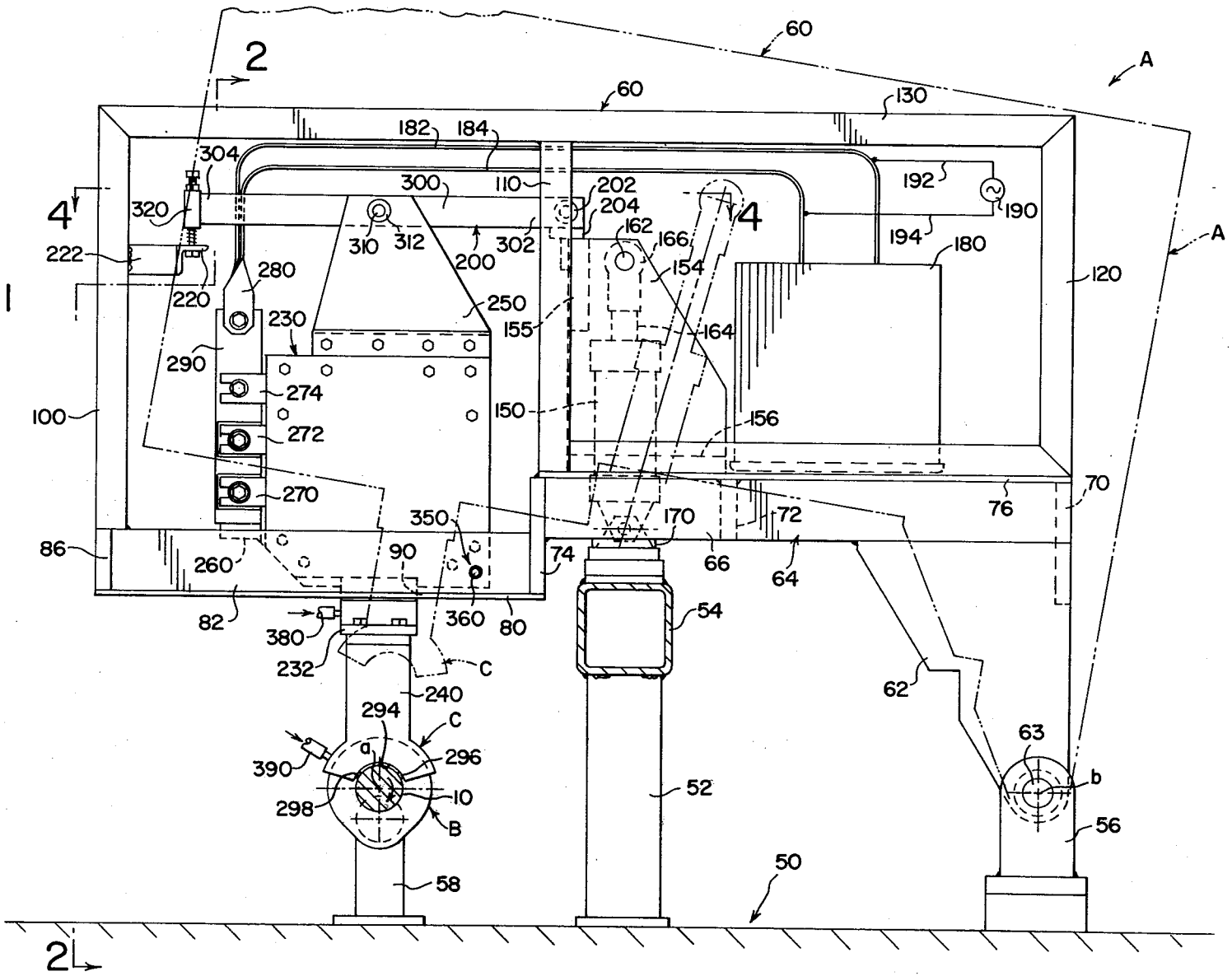
FIG. 1 is a front elevational view showing, somewhat schematically, the preferred embodiment of the present invention in two positions.

Referring now to the drawings wherein the showings are for the purpose of illustrating a preferred embodiment of the invention only, and not for the purpose of limiting same, FIGS. 1-4 show a device A for simultaneously inductively heating axially spaced cylindrical surfaces 10, 12, 14, 16 and 18 forming the main bearings of the crankshaft B as the crankshaft is rotated between center 20 and flange chuck 22 supported in journal blocks 24, 26, respectively. An appropriate device, shown schematically as motor 30, is used to drive chuck 22 for rotating crankshaft B about central axis a, which axis is generally the center of the axially spaced cylindrical surfaces 10-18. In practice, manufacturing tolerances and bowing or distortion of elongated crankshaft B can cause slight eccentricities and displacements of the cylindrical surfaces 10-18 forming the main bearings of the crankshaft. In the preferred embodiment, axially spaced inductors C, one for each surface to be heated by apparatus A, are used to heat simultaneously the cylindrical surfaces 10-18 as crankshaft B is being rotated. As illustrated, crankshaft B includes offset pins 40 which include cylindrical surfaces laterally displaced with respect to elongated, rotational axis a of the crankshaft. Heating device A is used for inductively heating and then quench hardening the main bearings of crankshaft B. Another appropriate device is used for inductively heating and quench hardening the surfaces of offset pins 40, which pins orbit about axis a during rotation of crankshaft B.

Apparatus A includes a generally stationary frame 50 for supporting transversely spaced, vertically extending stands 52 between which there is supported a transversely extending cross beam 54. Behind cross beam 54 there is provided transversely spaced pivot blocks 56, only one of which is shown. Journal blocks 24, 26 are fixed with respect to frame 50 on vertically extending pedestals 57, 58, as shown in FIG. 2. Onto the stationary frame 50 there is pivotally mounted a main support frame 60 for carrying, in unison, the axially spaced inductors C. This frame is pivotally mounted about an axis b and on spaced arms 62, only one of which is shown, which arms are connected to opposite sides of platform 64. Spaced arms 62 are connected to spaced pivot blocks 56 by a shaft 63 which allows pivotal movement between the solid line position and phantom line positions of FIG. 1. The solid line position is the heating position wherein inductors C are in their heating positions and the phantom line position is the retracted position wherein the inductors C are withdrawn from crankshaft B to allow loading and unloading of the crankshaft between center 20 and flange chuck 22. Platform 64 includes transversely spaced side rails 66 connected by transversely extending cross beams 70, 72, 74. An upper plate 76 is welded onto the side rails and cross beams and includes a generally rectangular opening 78 for clearance with respect to a pivoting mechanism as will be described later. A lower plate 80 extends outwardly from cross beam 74 and is reinforced by side rails 82, 84 and a front plate 86. Access openings 90 through plate 80 are provided for allowing passage of the electrical connections to the downwardly extending, axially spaced inductors C, which inductors are slightly movable with respect to the main support frame which includes lower plate 80. For this reason, access openings 90 provide for slight movement of the inductor as it extends through plate 80.

Vertically extending frame members 100, 102 are joined at front of apparatus A by an upper cross beam 104 all of which are formed from angle iron strips. Intermediate vertically spaced frame members 110, 112 and rear vertical frame members 120, only one of which is shown, are used to complete the frame work of main support frame 80, which frame includes a rear transverse cross beam 122 and laterally spaced, horizontally extending frame members 130, 132. Of course, other structural arrangements could be provided for supporting inductors C and moving the inductors in unison between a remote position and heating position. In the illustrated embodiment, frame 60 is pivoted about blocks 56. The pivoting action, in accordance with the illustrated embodiment, includes a cylinder 150 located between laterally spaced, vertically extending stands 152, 154 supported adjacent the front side by transversely extending brace 155 and at the lower edge by a support plate 156 having an access opening 158 generally matching rectangular opening 78. Lower trunnion 160 pivotally secures cylinder 150 onto cross beam 54. A pivot pin 162 connected to rod 164 by journal 166 pivotally connects the upper end of cylinder 150 to the upper portion of spaced stands 152, 154. By introducing hydraulic fluid into cylinder 150, rod 164 is extended to pivot main support frame 60 into the phantom line position shown in FIG. 1. Axially spaced stop blocks 170, 172 supported onto cross beam 54 below side rails 66 determine the solid line position shown in FIG. 1. Of course, shims or other adjusting arrangement could be used for adjusting the heating or solid line position of frame 60.

On plate 76 of platform 64 there is provided a generally standard set of capacitors 180 having a plurality of pairs of straps, each pair of which includes straps 182, 184. One pair of straps is connected to each of the inductors C for the purpose of correcting the power factor of the circuit used to inductively heat surfaces 10-18, in accordance with standard induction heating principles. Straps 182, 184 are slightly flexible to allow a certain amount of movement of inductors C with respect to frame 60 during rotation of crankshaft B. An appropriate high frequency power supply, which is schematically illustrated as generator 190, has leads 192, 194 connected in parallel to the inductors by straps 182, 184. This power supply may provide alternating current at any desired frequency for an induction heating effect at surfaces 10–18.

Figure 2:
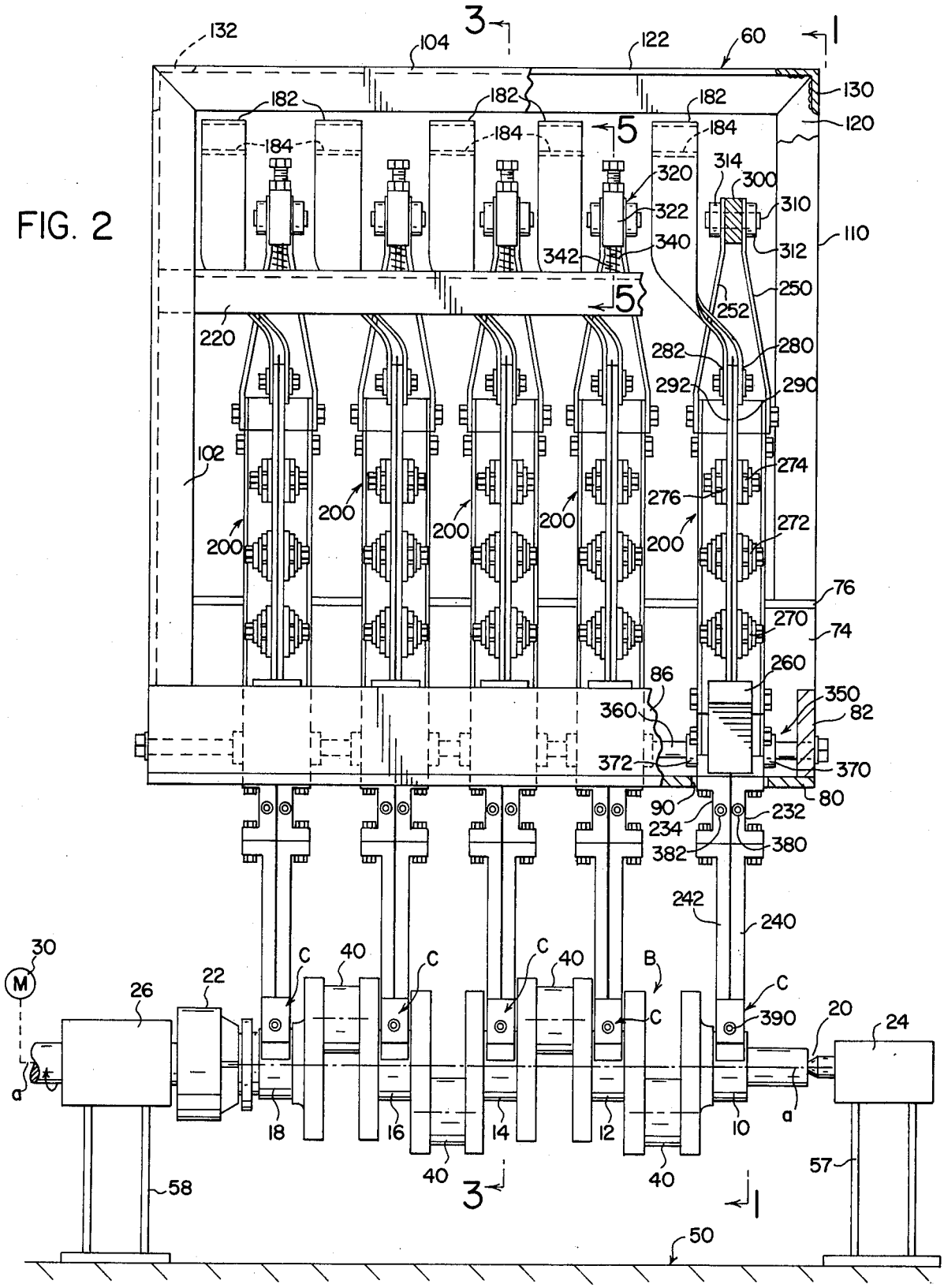
FIG. 2 is a front elevational view taken generally along line 2—2 of FIG. 1.
Figure 3:
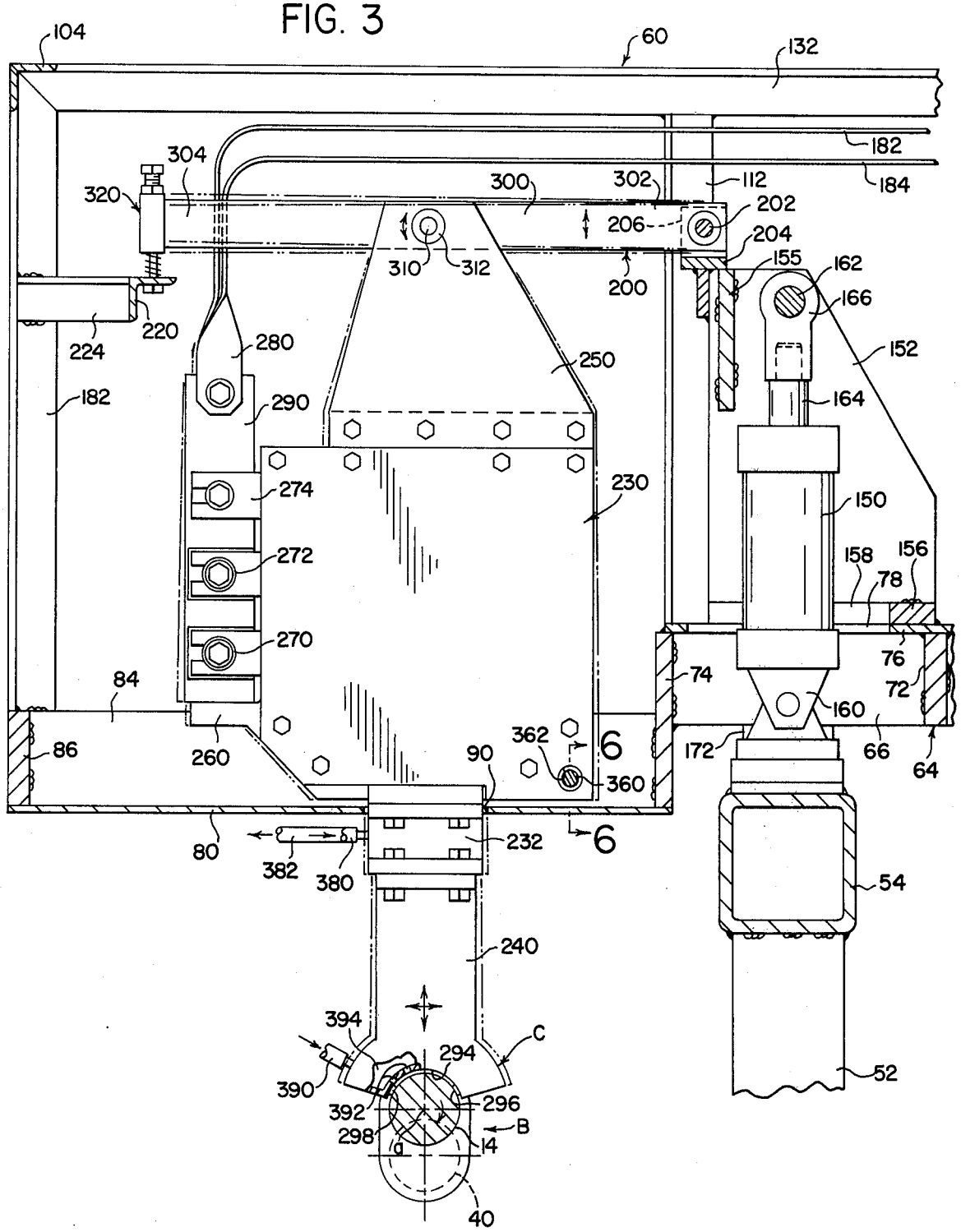
FIG. 3 is an enlarged, partial side elevational view taken generally along line 3—3 of FIG. 2.
Figure 4:
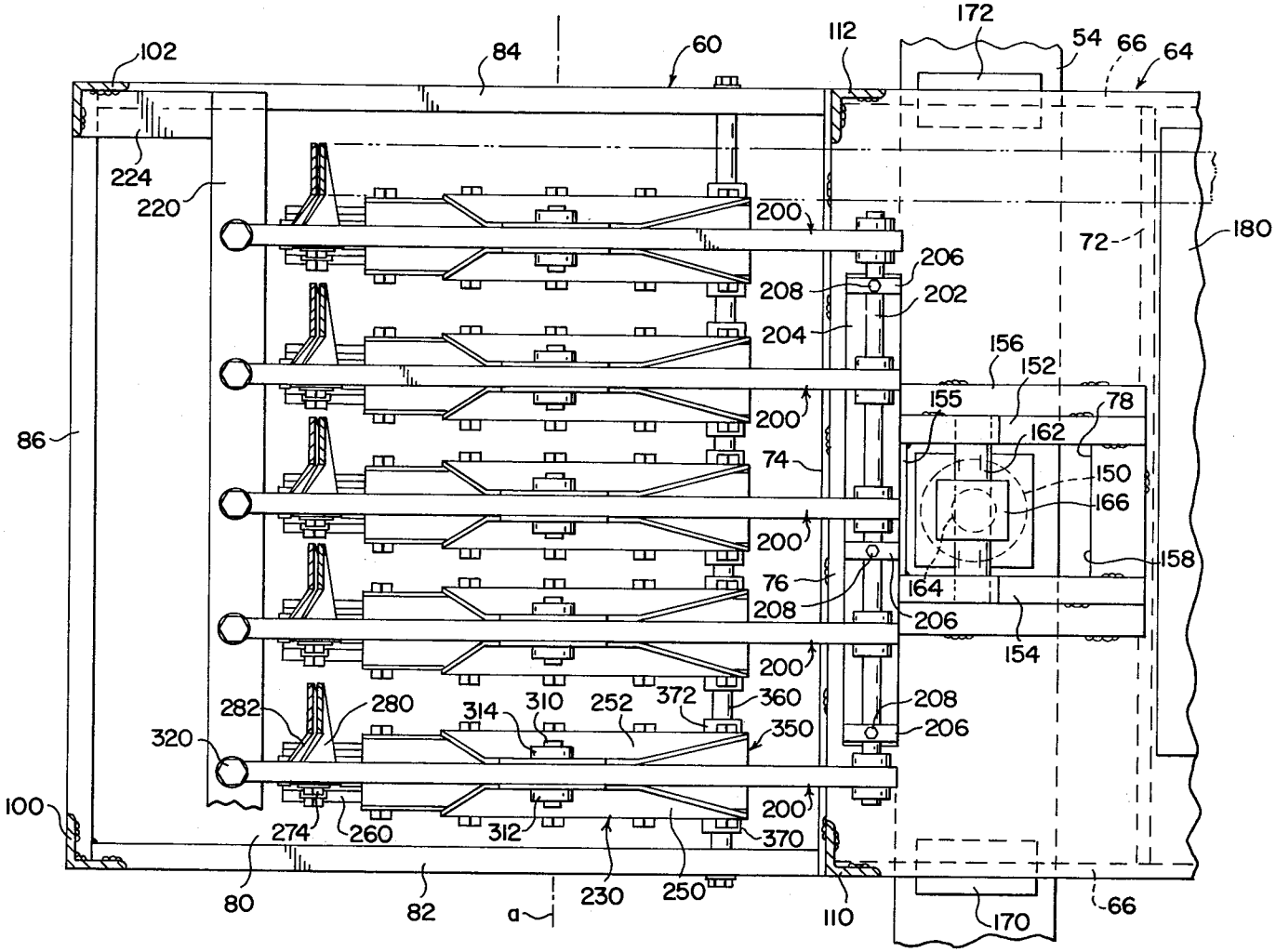
FIG. 4 is a schematic top view taken generally along line 4—4 of FIG. 1.

As so far described, main frame 60 is movable between a remote position and a heating position, as shown in FIG. 1. In the heating position, power supply 190 directs alternating current to inductors C spaced from and inductively coupled to axially spaced main bearing surfaces 10–18 while crankshaft B is being rotated by motor 30. After induction heating has taken place, quenching fluid is directed against surfaces 10–18 for quench hardening the surfaces in accordance with standard induction heating practices.

After main support frame 60 is in the heating position determined by spaced stop blocks 170, 172 each of the individual inductors C is movable in a slight amount which is generally ⅛-¼ inch in all directions in a plane vertical and generally perpendicular to axis a. To allow for this slight amount of movement which will compensate for variations in the concentricity of surfaces 10–18, each of the inductors is supported on separate, independently movable frame or sub frame 200. Only one of these frames will be described in detail and this description will apply equally to the individual inductor frames or sub frames 200 for each of the inductors. Frames 200 are movable independently on a common bearing rod 202 extending generally parallel to axes *a, b*. This bearing rod is supported on an elongated T-shaped bracket 204 welded to brace 155 and having transversely spaced stands 206. A plurality of bolts 208 lock common bearing rod 202 in the desired position on frame 60 so that the individual inductor frames 200 can pivot about common rod 202 in a plane generally perpendicular to axis *a*. A transversely extending rail 220 is supported by brackets 222, 224 onto frame 60 for engagement with each of the inductor support frames 200 by a structure to be described in more detail later.

Referring now more specifically to the individual inductor frames or sub frames 200, each of these frames includes an inductor holder 230. This holder may take a variety of structural designs for supporting inductor C through opening 90. The holder supports a pancake transformer connected between the inductor and straps 182, 184 forming one pair of connections to capacitor 180 and power supply 190. In the illustrated embodiment, inductor holder 230 includes connectors 232, 234 forming the output leads of the individual transformer and connected to downwardly extending, insulated bars 240, 242 forming the input leads of inductor C. Upper support plates 250, 252 provide an oscillating connection for holder 230 in a manner to be described later. An outwardly extending pedestal 260 is used to rigidify a connection between insulated connectors 270, 272, conducting connectors 274, 276 and upward terminals 280, 282 connected to vertically extending, rigid straps 290, 292. Pedestal 260 and the various connections hold rigid straps 290, 292. Connectors 270, 272 are unused taps for the pancake transformer in holder 230. Connectors 274, 276 are the active taps of the transformer in the illustrated embodiment. The remainder of holder 230 is a rigid structure with connectors 274, 276 providing electrical connections between straps 182, 184 and the individual transformer. A variety of internal wiring can be used to provide the electrical connection between the input terminals 280, 282 and inductor C.

Holder 230, as so far described, is fixed with respect to inductor C. As the inductor C is moved by riding along a surface 10–18, holder 230 moves in the same manner. This movement is allowed by the flexibility of elongated straps 182, 184 extending between sub frame 200 and capacitor 180 on main frame 60.

Inductor C has a matching cylindrical surface 294 which partially encircles surface 10 and extends through an angle of 180° or less. A desired spacing is maintained between cylindrical surface 10 and matching cylindrical surface 294 by an appropriate means, schematically illustrated as standard spacers 296, 298. An appropriate arrangement is provided for allowing movement of inductor C as crankshaft B is rotated about axis *a*. This structure on frame 200 includes elongated link 300 having ends 302, 304. An intermediate pivot pin 310 vertically supports inductor holder 230 and allows oscillation of the holder in a direction indicated by the arrows in FIG. 3. Collars 312, 314 are secured onto opposite sides of support plates 250, 252 to locate pin 310 through the plates and link 300. Pivotal movement of link 300 about rod 202 adjacent end 302 allows movement of link 300 as indicated by the arrows in FIG. 3. Thus, pin 310 can oscillate vertically and inductor holder 230 can oscillate horizontally to provide independent compound motion of inductors C at surface 10–18.

To control the amount of pressure exerted against the cylindrical bearing surface by spacers 296, 298, there is provided a spring biasing mechanism 320, best shown in FIG. 5. This mechanism includes a boss 322 formed integrally adjacent end 304 of link 300. This boss includes a central bore 324 receiving the inner end of a threaded spring abutment 330 having an integral upper adjusting nut 332 and an appropriate lock nut 334. A shoulder 336 on abutment 330 coacts with downwardly extending nose 338 to support a compression spring 340. An appropriate lower guide rod 342 supported on rail 220 forms a lower support for the compression spring. By this arrangement, link 300 is biased upwardly against the total weight of frame 200. The difference between the weight of frame 200 and the spring biasing counterbalance force created by spring 340 determines the amount of pressure exerted by spacers 296, 298 as they ride along the cylindrical surface being heated. The pressure can be adjusted by changing the position of threaded abutment 330 as is quite apparent in FIG. 5.

To provide additional support for the individual frames 200 there is provided a mechanism 350 for limiting the movement of inductor holder 230 in the plane generally perpendicular to axis *a*. This limiting mechanism can take a variety of forms; however, in accordance with the illustrated embodiment, a coacting pin and opening structure is used. A common pin 360 extending between transversely spaced side rails 82, 84 extends through bores or openings 362 of the individual inductor holders 230 of axially spaced sub frames 200. The bores or openings 362 are generally cylindrical in shape and have radius approximately ⅛-¼ inch larger than the radius of pin 360. In practice, this difference is approximately 3/16 of an inch. Consequently, movement limiting mechanism 350 allows movement of inductor holder 230 approximately 3/16 of an inch in all directions in a vertical plane. This type of movement can be allowed by the flexibility of straps 182, 184 and is sufficient to compensate for normal manufacturing tolerances between the bearing surfaces 10–18 and rotating axis *a* of crankshaft B. To prevent holders 230 from moving axially, common pin or rod 360 includes locating collars 370, 372 fixedly secured onto pin 360 on opposite sides of holder 230 by an appropriate means, such as illustrated set screws 374.

Although not necessary for the present invention, apparatus A can be provided with appropriate liquid cooling circuits for cooling the various current carrying components in accordance with normal induction heating practices. This concept is schematically illustrated as a coolant liquid inlet 380 and a coolant outlet 382. These are provided for each of the separate inductors C and a variety of conduits and circuits could be provided for the purpose of cooling inductors C by connection with flexible coolant lines in accordance with normal practice. Also in accordance with normal practice, inductors C include quenching fluid outlets or orifices 392 in cylindrical surface 294. Quenching liquid is directed through line 390 to the interior chamber 394 of inductor C for directing the quenching liquid onto the previously heated cylindrical surface by outlets 392. In this manner, the inductively heated surfaces are subsequently quench hardened. After simultaneously heating surfaces 10–18, crankshaft B can be dunk quenched to harden the heated surfaces.

In accordance with the invention, inductors C are moved in unison by frame 60 to the heating position. Thereafter, each of the inductors is allowed to move slightly with respect to the common frame by independently movable sub frames 200. In this manner, the inductors may be moved away from and toward the heating position without a long stroke counterbalancing arrangement. The counterbalancing is then provided for only slight movement by biasing or counterbalancing mechanism 320. As workpiece B is rotated, the inductors C are energized and follow along the axially spaced surfaces to inductively heat the surface for subsequent quench hardening by a quenching liquid.

Having thus defined the invention, it is claimed:

1. A device for inductively heating at least two cylindrical metal surfaces on an elongated workpiece having a central axis, said surfaces being generally concentric with said axis, said device comprising: an inductor for each surface and each inductor having a generally cylindrical coupling surface matching one of said metal surfaces; support means for carrying said inductors; means for moving said support means between a first position with said inductors spaced substantially from said cylindrical metal surfaces and a second fixed position with said inductors in their heating positions; stop means for supporting said support means in said second fixed position; an intermediate frame means for mounting each of said inductors onto said support means; each of said intermediate frame means comprising a first link extending generally horizontally over said workpiece axis and having first and second ends and an intermediate portion, means for mounting said link on said support means at said first end for pivotal movement toward and away from said workpiece and about an axis generally parallel to said central axis, a second link, means for pivotally mounting said second link on said intermediate portion of said first link for oscillation generally transverse to said workpiece axis and about an axis above and generally parallel to said central axis, means for mounting one of said inductors on said second link; and, means for selectively energizing said inductors.

2. A device as defined in claim 1 wherein said means for moving said support means includes means for pivoting said support means about an axis generally spaced from and parallel to said central axis.

3. A device as defined in claim 2 including means for biasing said frame means with respect to said support means and in a direction away from said workpiece when said inductors are in their heating positions.

4. A device as defined in claim 2 including means for limiting oscillating movement of said second link with respect to said frame means.

5. A device for inductively heating a cylindrical metal surface on an elongated workpiece having a central axis, said surface being generally concentric with said axis, said device comprising: an inductor having a generally cylindrical coupling surface matching said metal surface; support means for carrying said inductor; means for moving said support means between a first position with said inductor spaced substantially from said cylindrical metal surface and a second position with said inductor in its heating position; intermediate frame means for mounting said inductor onto said support means; said intermediate frame means comprising a first link having first and second ends, means for mounting said link on said support means at said first end for pivotal movement about an axis generally parallel to said central axis, a second link, means for pivotally mounting said second link on said first link for oscillation about an axis above and generally parallel to said central axis, means for mounting said inductor on said second link; means for selectively energizing said inductor, means for biasing said frame means with respect to said support means and in a direction away from said workpiece when said inductor is in its heating position, said biasing means including a compression spring means between said support means and said frame means.

6. A device as defined in claim 5 including means for limiting oscillating movement of said second link with respect to said frame means.

7. A device as defined in claim 6 wherein said limiting means includes an interacting pin element and an element having means defining an opening receiving said pin element, means for mounting one of said elements on said second link and means for mounting the other of said elements fixedly on said frame means.

8. A device for inductively heating a cylindrical metal surface on an elongated workpiece having a central axis, said surface being generally concentric with said axis, said device comprising: an inductor having a generally cylindrical coupling surface matching said metal surface; support means for carrying said inductor; means for moving said support means between a first position with said inductor spaced substantially from said cylindrical metal surface and a second position with said inductor in its heating position; intermediate frame means for mounting said inductor onto said support means; said intermediate frame means comprising a first link having first and second ends, means for mounting said link on said support means at said first end for pivotal movement about an axis generally parallel to said central axis, a second link, means for pivotally mounting said second link on said first link for oscillation about an axis above and generally parallel to said central axis, means for mounting said inductor on said second link; means for selectively energizing said inductor, and, means for limiting oscillating movement of said second link with respect to said frame means, said limiting means includes an interacting pin element and an element having means defining an opening receiving said pin element, means for mounting one of said elements on said second link and means for mounting the other of said elements fixedly on said frame means.

9. A device for inductively heating at least first and second axially spaced, generally cylindrical surfaces on a metal workpiece rotated about an axis generally concentric with said cylindrical surfaces, said device comprising a first inductor having a generally cylindrical surface adapted to surround only a portion of said first cylindrical surface; means fixed with respect to said first inductor and engaging said first cylindrical surface for maintaining a selected spacing between said cylindrical surface of said first inductor and said first cylindrical surface when said first inductor is in its heating position; a second inductor having a generally cylindrical surface adapted to surround only a portion of said second cylindrical surface; means fixed with respect to said second inductor and engaging said second cylindrical surface for maintaining a selected spacing between said cylindrical surface of said second inductor and said second cylindrical surface when said second inductor is in its heating position; support means for carrying said first and second inductors; means for moving said support means between a first position with said inductors spaced substantially from said first and second cylindrical surfaces and a second position with said first and second inductors in their heating positions with respect to said rotating workpiece; first sub frame means for mounting said first inductor onto said support means; second sub frame means for mounting said second inductor onto said support means; each of said sub frame means comprising a first link having first and second ends; means for mounting said link for pivotal movement above said workpiece and about an axis generally parallel to said workpiece axis and spaced transversely therefrom; a second link having first and second ends; means for mounting said second link for oscillation on said first link intermediate its ends about an axis parallel and above said workpiece axis; means for mounting one of said inductors on said second end of said second link; and means for simultaneously energizing said first and second inductors.

10. A device as defined in claim 9 including means for biasing each of said sub frame means with respect to said support means and in a direction away from said workpiece when said inductors are in said heating positions.

11. A device as defined in claim 10 wherein said biasing means includes a compression spring means between said support means and each of said sub frame means.

12. A device as defined in claim 9 including means for limiting oscillating movement of said second link with respect to said frame means.

13. A device as defined in claim 9 wherein said means for moving said support means includes means for pivoting said support means about an axis generally spaced from and parallel to said central axis.

14. A device as defined in claim 9 wherein said energizing means includes a transformer and means for mounting said transformer on said sub frame means.

* * * * *